US008585201B2

(12) United States Patent
Miura

(10) Patent No.: US 8,585,201 B2
(45) Date of Patent: Nov. 19, 2013

(54) IMAGE FORMING DEVICE WITH A ROTATABLY SUPPORTED OPENING AND CLOSING MEMBER

(75) Inventor: Katsuro Miura, Aichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 212 days.

(21) Appl. No.: 13/076,462

(22) Filed: Mar. 31, 2011

(65) Prior Publication Data

US 2012/0001993 A1 Jan. 5, 2012

(30) Foreign Application Priority Data

Jun. 30, 2010 (JP) ..... 2010-150046

(51) Int. Cl.
*B41J 29/13* (2006.01)

(52) U.S. Cl.
USPC ..... 347/108; 347/104; 399/110

(58) Field of Classification Search
USPC ..... 347/104, 108, 109; 400/693, 691; 399/110, 125
IPC ..... B41J 29/13
See application file for complete search history.

(56) References Cited

U.S. PATENT DOCUMENTS

2004/0017460 A1* 1/2004 Kagami et al. ..... 347/104
2004/0047662 A1* 3/2004 Ozawa et al. ..... 399/388
2006/0221168 A1* 10/2006 Wakiyama ..... 347/108
2007/0147882 A1* 6/2007 Igarashi ..... 399/110
2009/0317125 A1* 12/2009 Tomatsu ..... 399/110
2011/0049791 A1 3/2011 Osakabe

FOREIGN PATENT DOCUMENTS

| | | |
|---|---|---|
| JP | 6-23054 | 3/1994 |
| JP | 7-309454 | 11/1995 |
| JP | 9-26742 | 1/1997 |
| JP | 2005-219860 | 8/2005 |

* cited by examiner

*Primary Examiner* — Manish S Shah
*Assistant Examiner* — Roger W Pisha, II
(74) *Attorney, Agent, or Firm* — Banner & Witcoff, Ltd.

(57) ABSTRACT

An image forming device, including: a housing having an opening; an opening and closing member rotatably supported by the housing between an opened state and a closed state, a pair of shaft parts respectively provided at lower portions of side walls of the opening and closing member; space formed under a lower edge of the opening and closing member; and a pair of shaft support members respectively provided on the housing, and wherein the pair of shaft support members respectively have shaft holes into which the pair of shaft parts are respectively inserted; each shaft support member has a fixed part and a deformable part having the shaft hole; and the deformable part is formed such that the lower edge part of the deformable part is positioned on a center side of the opening and closing member with respect to a position of the fixed part.

8 Claims, 7 Drawing Sheets

IMAGE FORMING DEVICE WITH A ROTATABLY SUPPORTED OPENING AND CLOSING MEMBER

CROSS-REFERENCE TO RELATED APPLICATION

This application claims priority under 35 U.S.C. §119 from Japanese Patent Application No. 2010-150046, filed on Jun. 30, 2010. The entire subject matter of the application is incorporated herein by reference.

BACKGROUND

1. Technical Field

Aspects of the present invention relate to an image forming device.

2. Related Art

An image forming device of the type in which an image formation unit for forming an image is accommodated in a housing and an opening is formed on one of sides of the housing is widely used. In such an image forming device, the opening serves as a manual paper feed path extending from the outside of the housing to the image formation unit.

The image forming device of this type has an opening and closing member attached to the housing to be able to swing about a lower edge portion thereof. Specifically, the opening and closing member is provided to be able to swing between an opened state where the opening is exposed and a closed state where the opening is covered. The opening and closing member is a supply tray for manually feeding a recording medium, and is moved to the opened state when the manual feeding is conducted. On the other hand, when the opening and closing member is not used (i.e., the manual feeding is not performed), the opening and closing member is closed.

SUMMARY

Regarding the image forming device of the above described type, in many cases empty space is formed under the lower edge of the opening and closing member being in the closed state. The empty space serves as a clearance for allowing the lower edge of the opening and closing member to move without interfering with the housing when the opening and closing member is moved from the closed state to the opened state. As a structure for supporting the opening and closing member to be able to swing, one of a shaft part and a shaft hole is provided on the housing side and the other of the shaft part and the shaft hole is provided on the opening and closing member side.

There is a case where a user puts the user's hand on the lower edge (i.e., the empty space) of the opening and closing member to lift up the image forming device. In this case, a force pointing upward is applied from the user's hand to the lower edge of the opening and closing member. As a result, a force acts on the axis part and the axis hole. Furthermore, in this case, a part of the housing or the opening and closing member having the axis hole is elastically deformed by the force, and thereby the shaft part may drop off from the shaft hole. That is, the opening and closing member may drop off from the housing when the user puts the user's hand on the lower edge of the opening and closing member to lift the image forming device.

Aspects of the present invention are advantageous in that they provide an image forming device configured to prevent an opening and closing member from dropping off from a housing even when a force pointing upward is applied to a lower edge side of the opening and closing member.

According to an aspect of the invention, there is provided an image forming device, comprising: a housing comprising an opening on one side thereof, the housing accommodating an image formation unit; an opening and closing member rotatably supported by the housing, the opening and closing member being able to swing, about a swinging axis provided on a lower side of the opening and closing member, between an opened state where the opening is exposed and a closed state where the opening is covered with the opening and closing member, a pair of shaft parts respectively provided at lower portions of side walls of the opening and closing member to protrude outward to become away from each other, the side walls being formed to face with each other while sandwiching a lower edge of the opening and closing member between the side walls; space formed under the lower edge of the opening and closing member in the closed state of the opening and closing member; and a pair of shaft support members respectively provided on the housing at portions where the housing faces the side walls of the opening and closing member. In this configuration, the pair of shaft support members respectively have shaft holes into which the pair of shaft parts are respectively inserted; each of the pair of shaft support members has a fixed part provided at an upper portion of the shaft support member to be fixed to the housing, and a deformable part integrally formed with the fixed part to extend downward from the fixed part, the deformable part comprising a corresponding one of the shaft holes at a lower edge part of the deformable part; and the deformable part is formed such that the lower edge part of the deformable part is positioned on a center side of the opening and closing member with respect to a position of the fixed part when viewed from the side on which the opening is formed so that, when a force pointing upward is applied to the lower edge of the opening and closing member, the deformable part is deformed such that the shaft holes respectively approach the side walls of the opening and closing member.

BRIEF DESCRIPTION OF THE ACCOMPANYING DRAWINGS

DETAILED DESCRIPTION

Hereafter, an embodiment according to the invention will be described with reference to the accompanying drawings.

Figure 1:
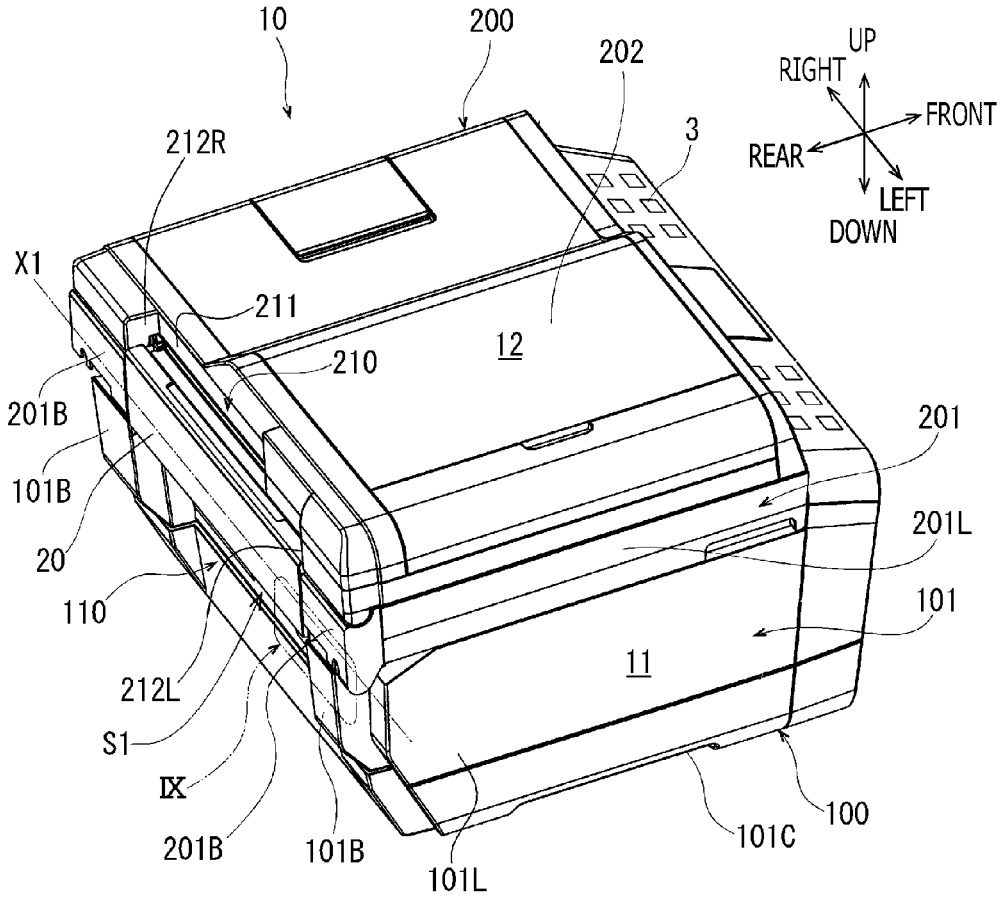
FIG. 1 is a perspective view of an MFP (Multifunction Peripheral) according to an embodiment illustrating a situation where a supply tray is in a closed state.

A multifunction peripheral (MFP) 10 shown in FIG. 1 is an example of an image forming device according to the embodiment. The MFP 10 is able to execute various processes including an image forming process for forming an image on a recording medium (e.g., a sheet of paper or an overhead projector (OHP) sheet), an image reading process for reading an image from a document and generating electronic data, and a communication process for transmitting data to and receiving data from an external device. In FIG. 1, a side on which an operation panel 3 is provided is referred to as a front side, and a side opposite to the operation panel 3 side is referred to as a rear side. A left hand and a right hand defined when the MFP 10 is viewed from the front side are referred to as a left side and a right side, respectively. All of the directions in the drawings from FIG. 2 are also defined by the directions shown in FIG. 1.

Figure 2:
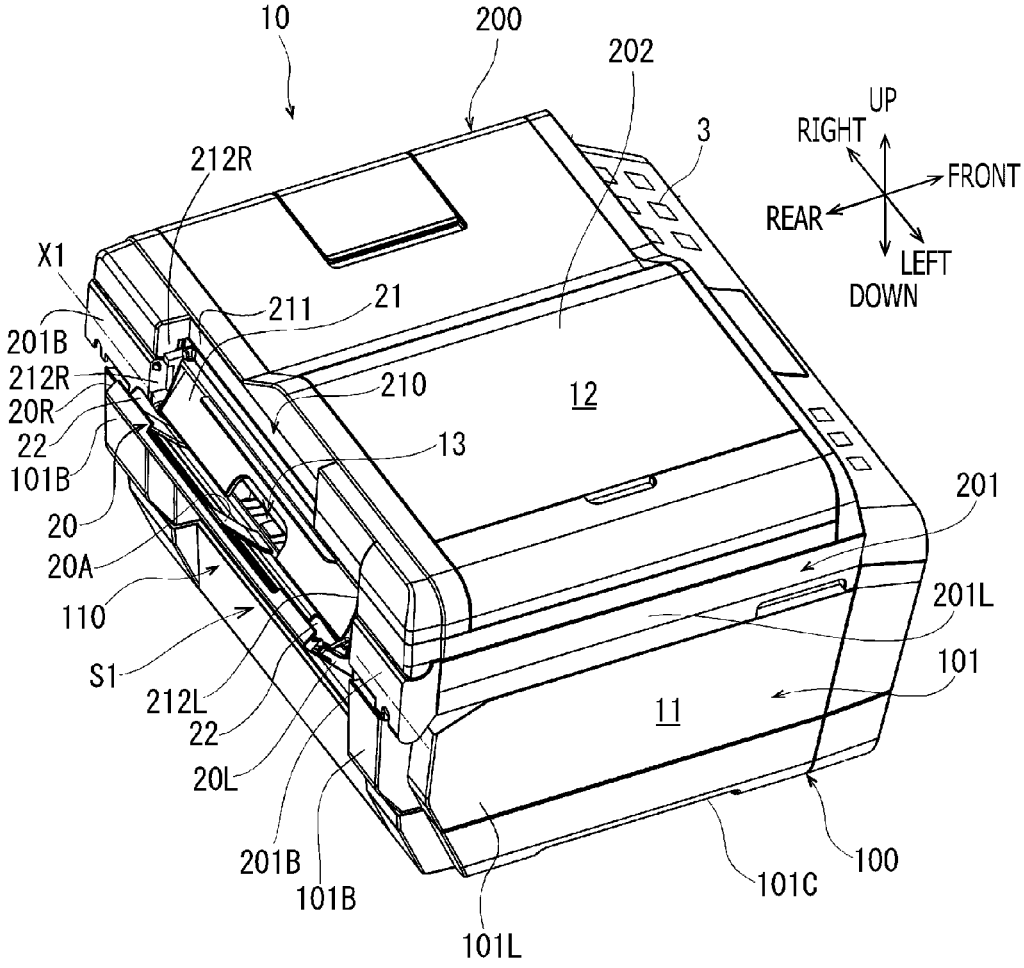
FIG. 2 is a perspective view of the MFP according to the embodiment illustrating a situation where the supply tray is in an opened state.

As shown in FIGS. 1 and 2, the MFP 10 includes a reading housing 200 having a shape of a substantially rectangular solid which is flat in the vertical direction, and an image formation housing 100 which is thicker than the reading housing 200 in the vertical direction and supports the reading housing 200 from the lower side.

Figure 5:
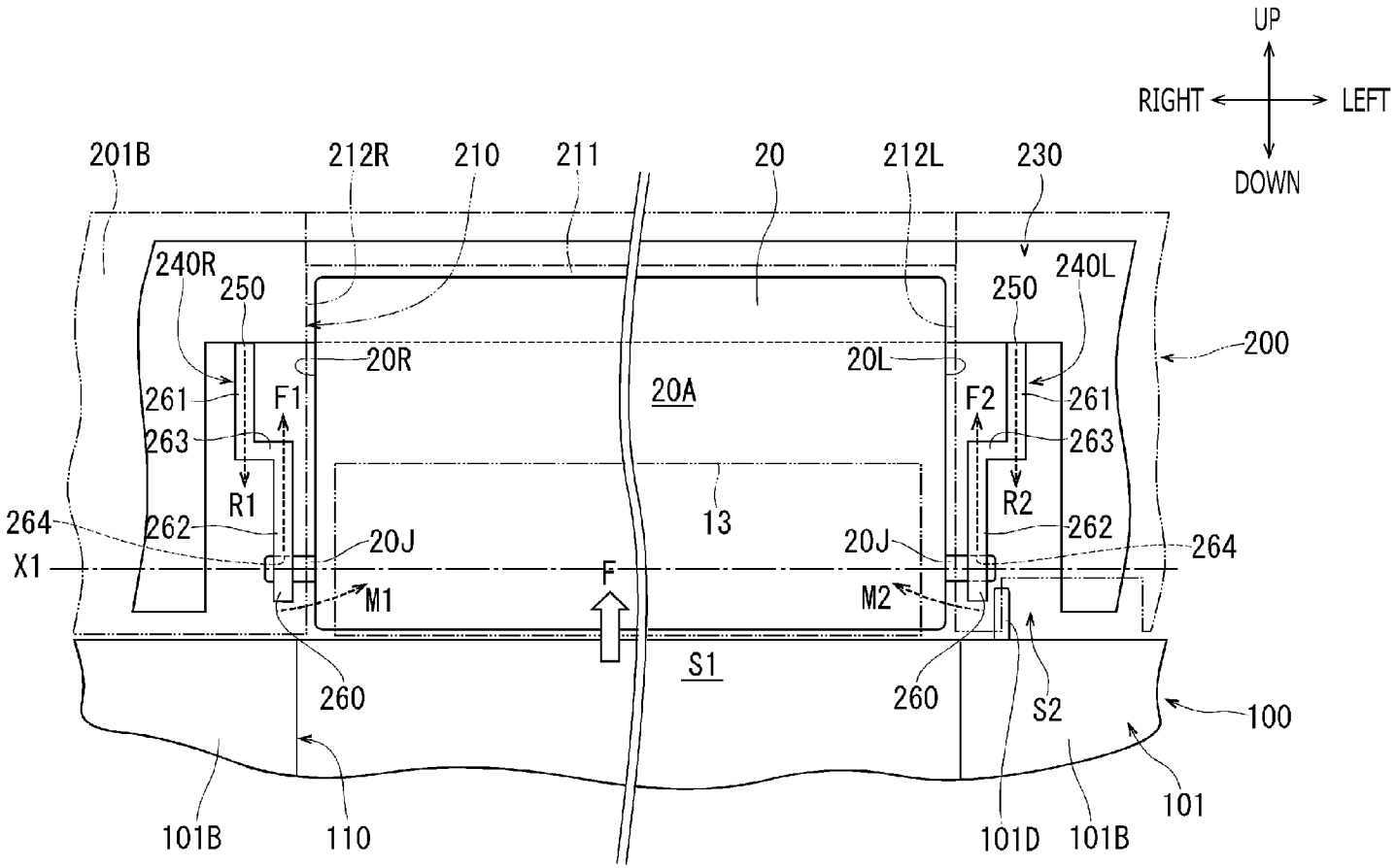
FIG. 5 is a rear view of the MFP generally illustrating a rear face of a reading housing of the MFP.
Figure 6:
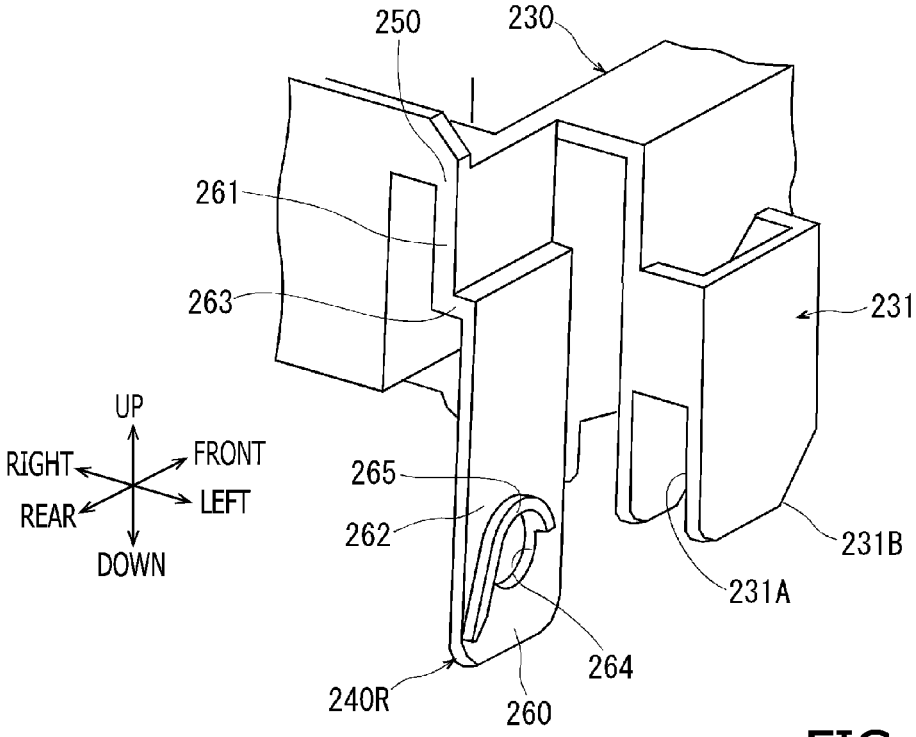
FIG. 6 is a partial perspective view of a shaft support member and a positioning member provided on a scanner base constituting the reading housing.

The reading housing 200 includes a first cover 201 which has a frame-like shape and is configured to be exposed on the rear side, the left side and the right side (in FIG. 1, a left side face 201L and a rear face 201B of the first cover 201 are illustrated), a second cover 202 which covers an upper portion of the first cover 201, and a scanner base 230 which is covered with the first and second covers 201 and 202 (see FIGS. 5 and 6).

The image formation housing 100 includes a third cover 101 which has a frame-like shape and is configured to be exposed on the rear side, the left side and the right side, and an inner frame (not shown) covered with the third cover 101. At the lower portion of a left side face 101L and a right side face (not shown) of the third cover 101, a grip part 101C is formed to have a recessed shape.

As shown in FIGS. 1 and 2, at an upper portion on the front side of the reading housing 200, the operation panel 3 is provided. The operation panel 3 is used to control an image reading unit 12 and an image formation unit 11. The operation panel 3 is provided with a liquid crystal panel and various operation buttons. The MFP 10 is configured to execute various functions in accordance with user operations conducted through the operation panel 3.

In order to achieve downsizing of the MFP 10, an opening 13 and a supply tray 20 for manual paper feeding are provided on the rear face of the reading housing 200. The supply tray 20 is supported by the rear face of the reading housing 200. Specifically, the supply tray 20 is provided to be able to swing about a swinging axis X1 so that the supply tray 20 is movable between an opened state (shown in FIG. 2) where the supply tray 20 is inclined with respect to the rear face of the reading housing 200 and the opening 13 is exposed and a closed state (shown in FIG. 1) where the supply tray 20 is positioned in the upright position and the opening 13 is covered.

Figure 3:
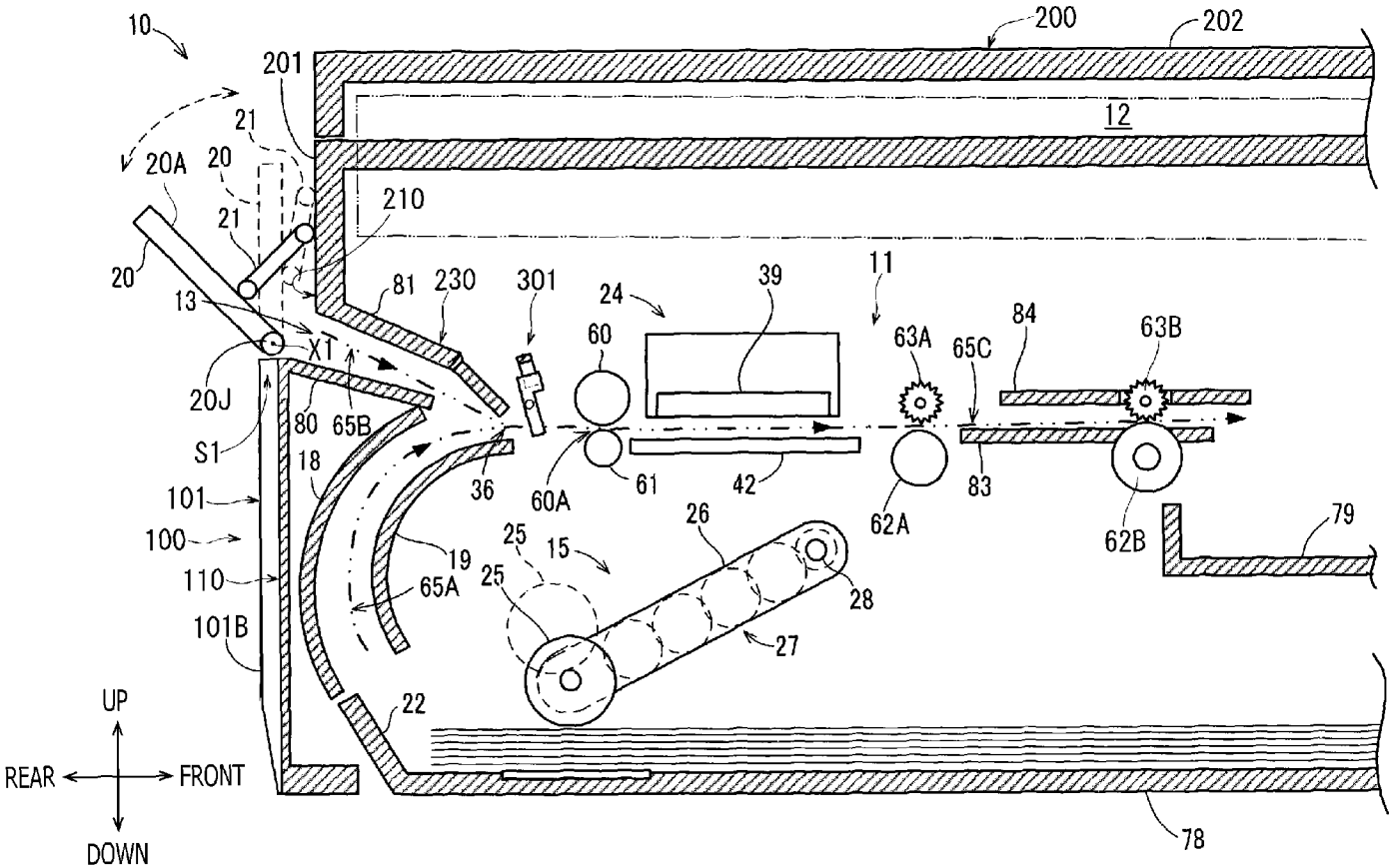
FIG. 3 is a vertical cross section illustrating an inner configuration of an image formation unit of the MFP.

As shown in FIG. 3, the image reading unit 12 is accommodated in the reading housing 200. The image reading unit 12 has a general configuration in which a flat bed scanner (FBS) and an automatic document feeder (ADF) are provided. Since a configuration of a reading device known in the art can be employed as the image reading unit 12, the configuration of the image reading unit 12 is not explained in detail.

As shown in FIG. 3, in the image formation housing 100, the image formation unit 11 configured to form an image through an inkjet recording process is accommodated. Various types of image formation devices including an electrophotographic type device can be employed as the image formation unit 11.

The image formation unit 11 includes a paper supply cassette 78, a carrying unit 15, an inkjet recording unit 24 and an ejected paper holding unit 79. These components of the image formation unit 11 are supported by the inner frame (not shown).

The paper supply cassette 78 has a box-shape whose upper side is opened, and accommodates the recording medium therein. The paper supply cassette 78 is located in the bottom portion of the image formation housing 100. Although not shown in the drawings, the paper supply cassette 78 is attached to the image formation housing 100 by inserting the paper supply cassette 100 from the front side of the third cover 101 toward the rear side. By drawing the paper supply cassette 78 in the inverse direction, the paper supply cassette 78 can be drawn to the outside of the image formation housing 100.

The ejected paper holding unit 79 holds the recoding medium on which an image has been formed by the image formation unit 11. In the image formation housing 100, the ejected paper holding unit 79 is arranged at a position above the paper supply cassette 78 and shifted toward the front side with respect to the paper supply cassette 78.

In the image formation housing 100, a curved carrying path 65A and a horizontal carrying path 65C are provided. The curved carrying path 65A extends upward in a slanting direction from the rear edge of the paper supply cassette 78 located at the bottom portion and then turns toward the front side. The horizontal carrying path 65C continuously extends in the horizontal direction from the curved carrying path 65A to the ejected paper holding unit 79. The curved carrying path 65A is partitioned by curved guide members 18 and 19 which face with each other at a certain interval in the front and rear direction. The horizontal carrying path 65C is partition by a plate-like platen 42, a plate-like guide member 83 and a plate-like guide member 84. The platen 42 is formed to extend substantially in the horizontal direction from the upper edges of the curved guide members 18 and 19 toward the front side. The guide member 83 is formed to extend substantially in the horizontal direction from the front side of the platen 42 to the ejected paper holding unit 79. The guide member 84 is located above the guide member 83 to face the guide member 83 at a certain interval.

In the image formation housing 100, a manual feeding path 65B is formed to extend downward in a slanting direction from the opening 13 and to be connected to the curved carrying path 65A at a joint point 36. The manual feeding path 65B is partitioned by guide members 80 and 81 which extend in the front and rear direction to face with each other at a constant interval. The guide member 80 is arranged at the upper rear portion of the inner frame constituting the image formation housing 100. The guide member 81 is arranged at the lower rear portion of the inner frame constituting the reading housing 200.

In the vicinity of the joint point 36, a position detection sensor 301 is provided. The position detection sensor 301 detects a position of the leading edge of the recording medium being carried along the curved carrying path 65A or a position of the leading edge of the recording medium being inserted along the manual feeding path 65B via the opening 13.

The carrying unit 15 includes a feed roller 25 arranged above the paper supply cassette 78, a first carrying roller 60 and a pinch roller 61 arranged between the platen 42 and the upper side of the curved guide members 18 and 19, a second carrying roller 62A and a spur roller 63A provided between the platen 42 and the guide members 83 and 84, and a third carrying roller 62B and a spur roller 63B arranged on the midway point of the guide members 83 and 84.

The feed roller 25 is provided to be rotatable at the tip of an arm 26 which is rotatable about a base shaft 28. The arm 26 is provided with a power transmission mechanism 27 which includes a plurality of gears to transmit a driving force from a driving source (not shown) to the feed roller 25 and to rotate the feed roller 25. The feed roller 25 is arranged such that, through the downward rotation of the arm 26, the feed roller 25 is pressed against the top face of the recording medium accommodated in the paper supply cassette 78. In this state, the feed roller 25 rotates by receiving the rotational driving force via the power transmission mechanism 27, so as to pick up the recording medium and send out the recording medium to the curved carrying path 65A.

The first carrying roller 60 and the pinch roller 61 send out the recording medium to the platen 42 while sandwiching the recording medium therebetween. Each of the pair of the second carrying roller 62A and the spur roller 63A and the pair of the third carrying roller 62B and the spur roller 63B sandwiches the recording medium which has passed the top face of the platen 42, and carries the recording medium to the downstream side (i.e., the ejected paper holding unit 79 side). In this case, the first carrying roller 60, the second carrying roller 62A and the third carrying roller 62B are intermittently driven by a driving source (not shown) so as to carry the recording medium in steps of a predetermined feeding width.

The inkjet recording unit 24 is provided above the platen 42. The inkjet recording unit 24 is arranged to reciprocate along a guide rail (not shown) extending in the left and right direction (i.e., in a main scanning direction) which is perpendicular to the paper face of FIG. 3. The inkjet recording unit 24 reciprocates in the main scanning direction each time the recording medium stops on the platen 42 after being carried by the predetermined feeding width. During such a reciprocating motion of the inkjet recording unit 24, minute drops of ink supplied from an ink cartridge (not shown) are ejected from a nozzle unit 39 so that an image is formed on the recording medium.

Hereafter, image formation performed by the image formation unit 11 is explained.

When a user operates the operation unit panel 3 to input a command for starting an image formation process for forming an image on the recording medium in the paper supply cassette 78, a controller (not shown) controls the carrying unit 15 to pick up the recording medium in the paper supply cassette 78 and to send out the recording medium to the curved carrying path 65A. Then, the first, second and third carrying rollers 60, 62A and 62B cooperate with each other under control of the controller (not shown) so that an image is formed on the recording medium. Next, the recording medium on which an image has been formed is carried to the ejected paper holding unit 79.

For image formation by manual feeding of the recording medium, the user moves the supply tray 20 to be set in the opened state (as indicated by a solid line in FIG. 3), and inserts a sheet of recording medium into the opening 13. Then, the recording medium passes through the opening 13 in a state where the back face of the recording medium is supported by the supply tray 20, and is inserted into the image formation housing 100 while being guided by the guide members 80 and 81 along the manual feeding path 65B. As a result, the leading edge of the recording medium is inserted into a nipping position 60A of the first carrying roller 60 and the pinch roller 61. In this case, the position detection sensor 301 detects the position of the leading edge of the recording medium being inserted along the manual feeding path 65B, and informs the controller that the recording medium has been fed by manual feeding.

When the user operates the operation panel 3 to input a command for starting the image formation on the recording medium fed by manual feeding, the first, second and third rollers 60, 62A and 62B cooperate with each other under control of the controller, so as to form an image on the recording medium which has been fed by manual feeding. Then, the recording medium on which an image has been formed is carried to the ejected paper holding unit 79.

Hereafter, the supply tray 20 is explained.

For downsizing, as shown in FIG. 1, the supply tray 20 is configured such that, in the unused state, the supply tray 20 is substantially in plane with the rear face 201B of the first cover 201 constituting the reading housing 200. Hereafter, the configuration of the rear face of the reading housing 200 which supports the supply tray 20, the rear face of the image formation housing 100 located under the supply tray 20, and the supply tray 20 are explained in detail.

Figure 4:
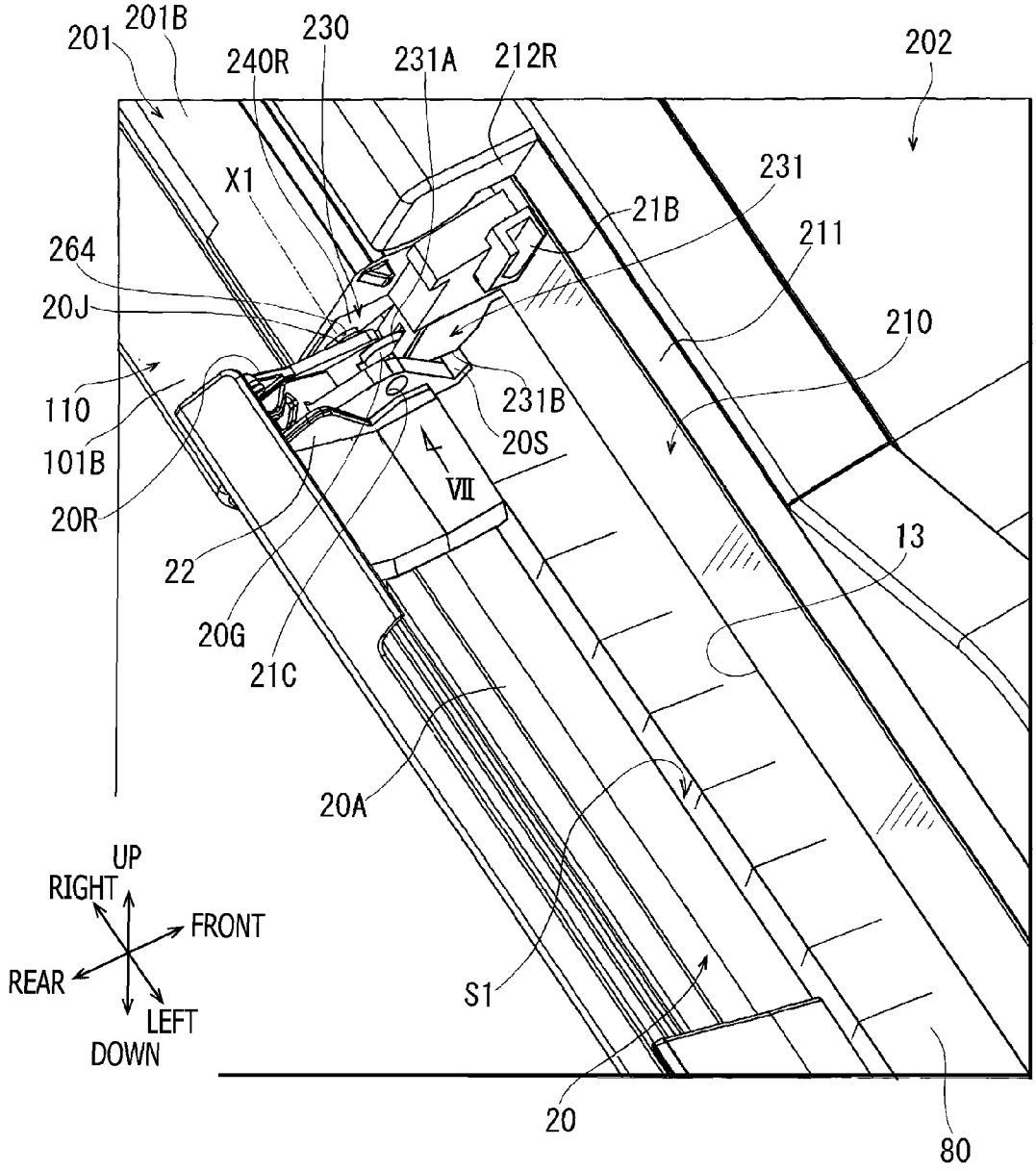
FIG. 4 is partial perspective view illustrating an opening and the supply tray in an enlarged view.

As shown in FIGS. 2 and 4, a recessed part 210 is formed at the central portion of the rear face 201B of the first cover 201 to extend in the vertical direction in a form of a groove. The recessed part 210 includes a back face 211, and inner faces 212L and 212R which face with each other in the left and right direction to sandwich the back face 211 therebetween. The recessed part 210 is formed to extend from the upper edge to the lower edge of the rear face 201B.

As shown in FIGS. 3 and 4, under the recessed part 210, the opening 13 is formed as a slender opening extending in the left and right direction. The width of each of the opening 13 and the recessed part 210 is set to be wide in accordance with the width of the recording medium which the image formation unit 11 supports.

It should be noted that in FIG. 4 a sheet guide 21 shown in FIG. 2 is omitted so that the opening 13 and the supply tray 20 can be seen easily. Although FIG. 4 illustrates only the right side portions of the reading housing 200, the opening 13 and the supply tray 20, the left side portions of the reading housing 200, the opening 13 and the supply tray 20 have substantially the same configuration as that of the right side portions of the reading housing 200, the opening 13 and the supply tray 20, except for cases explained particularly. Therefore, in the following, explanations focus on the configuration of the right side portions of the reading housing 200, the opening 13 and the supply tray 20 are explained, and explanations of the left side portions of the reading housing 200, the opening 13 and the supply tray 20 are simplified or omitted.

As shown in FIGS. 1 to 3, a recessed part 110 is formed at the central portion in the left and right direction on the rear face 101B of the third cover 101 constituting the image formation housing 100 to have a form of a groove extending in the vertical direction. The recessed part 110 is formed to extend from the upper edge to the lower edge of the third cover 101 to be continued to the recessed part 210. That is, the rear face 201B of the reading housing 200 is formed to be recessed toward the inside of the MFP 10 at the central portion thereof where the opening 13 is formed, with respect to the right and left edge potions of the rear face 201B. In this structure, when the supply tray 20 is closed, the rear face 201B is in plane with the supply tray 20. Similarly, the rear face 101B of the image formation housing 100 is formed to be recessed at the central portion thereof in the left and right direction, with respect to the right and left edge portions of the rear face 101B.

As shown in FIGS. 4 and 5, the supply tray 20 includes a base plate 20A having a form of a slender rectangular shape extending in the left and right direction, and right and left side walls 20R and 20L which are respectively formed to stand at the right and left edges of the supply tray 20 so as to face with each other in the state where the base plate 20A intervenes between the right and left side walls 20R and 20L. The width of the base plate 20A in the left and right direction is wider than that of the opening 13, and is narrower than that of the recessed part 210.

As shown in FIG. 4, on the surface of the base plate 20A supporting the back face of the recording medium, a width adjustment guide 22 is provided to be slidable in the left and right direction. The width adjustment guide 22 slides between a position corresponding to the recording medium having the maximum permissible size that the MFP 10 supports and a position corresponding to the recording medium having the minimum permissible size that the MFP 10 supports. On the base plate 20A, a sheet of recording medium having various sizes (e.g., A4 size) can be placed.

As shown in FIG. 5, at portions near to lower edges of the right and left side walls 20R and 20L, a pair of shaft parts 20J are formed. Each shaft part 20J has a shape of a circular cylinder, and has a center axis equal to the swinging axis X1. The shaft parts 20J are formed to protrude outward respectively from the right and left side walls 20R and 20L to become away from each other.

The inner surfaces 212L and 212R of the recessed part 210 respectively face the left and tight side walls 20L and 20R of the supply tray 20. As shown in FIG. 4, at the positions of the inner surfaces 212L and 212R, parts of the scanner base 230 is respectively exposed. At the positions where the parts of the scanner baser 230 are exposed, a shaft support member 240R and a positioning part 231 are integrally formed on the right side and a shaft support member 240L and a positioning part 231 are integrally formed on the left side. FIG. 6 illustrates the right shaft support member 240R and the positioning part 231. The left shaft support member 240L and the positioning part 231 have substantially the same structure as that of the right shaft support member 240R and the positioning part 231.

As shown in FIG. 5, each of the shaft support members 240L and 240R is a thin plate-like member. The shaft support members 240L and 240R are formed to extend from the scanner base 230 so as to face with the left and right side walls 20L and 20R of the supply tray 20, respectively. As shown in FIGS. 5 and 6, each of the shaft support members 240L and 240R has a fixed part 250 fixed to the scanner base 230 at an upper edge part thereof, and has a deformable part 260 which is integrally formed with the fixed part 250 and is formed to extend downward.

The deformable part 260 includes a first dropping part 261 extending downward in the substantially vertical direction from the fixed part 250, a crank part 263 which is formed to horizontally extend from the lower edge of the first dropping part 261 toward the central part of the supply tray 20 and bends in a shape of a crank, and a second dropping part 262 which extends downward in the substantially vertical direction from the edge of the crank part 263 opposite to the edge of the crank part 263 connected to the first dropping part 261. The second dropping part 262 is formed to be longer than the first dropping part 261. Therefore, the crank part 263 is positioned on the upper side with respect to the center of each of the shaft support members 240L and 240R. With this configuration, the deformable part 260 has weaker rigidity in the left and right direction with respect to the rigidity in the front and rear direction. That is, the lower edge part of the deformable part 260 is easily deformed in the left and right direction. As shown in FIG. 5, when viewed from the side facing the rear face 201B of the first cover 201 constituting the reading housing 200, each deformable part 260 is positioned such that the lower edge at which a shaft hole 264 is formed is shifted toward the center of the supply tray 20 with respect to the fixed part 250.

At the lower edge portion of the second dropping part 262, the shaft hole 264 is formed to penetrate in the direction of the swinging axis X1. Each shaft hole 264 is formed to have a diameter slightly larger than the outer diameter of each shaft part 20J. By inserting the shaft parts 20J to the shaft holes 264, respectively, the supply tray 20 can be supported to be rotatable about the swinging axis X1. Since the lower portion of the deformable part 260 is formed to be deformable relatively easily, it is possible to easily insert the shaft parts 20J into the shaft holes 264, respectively, by causing the lower portions of the deformable parts 260 to be deformed outward (i.e., in the direction in which the deformable parts 260 move away with respect to each other). Such a configuration makes it possible to simplify the installation work for attaching the supply tray 20 to the reading housing 200 (the scanner base 230).

As shown in FIG. 6, on the left side surface (facing the side wall 20R of the supply tray 20) of the second dropping part 262 of the right deformable part 260, a rib-like guide part 265 is integrally formed to protrude toward the side wall 20R. The guide part 265 is formed to blanket the upper half circle of the periphery of the shaft hole 264 and to further extend downward in a slanting direction. By inserting the right shaft part 20J into the right shaft hole 264 while guiding the right shaft part 20J along the guide part 265, it becomes possible to easily insert the shaft part 20J into the shaft hole 264, so that the installation work for attaching the supply tray 20 to the reading housing 200 can be eased. It should be noted that the guide part 265 may be provided on one of the shaft support members 240L and 240R, or may be guide parts are formed on both of the shaft support members 240L and 240R. The guide part 265 may be formed to be a bored part.

Figure 7:
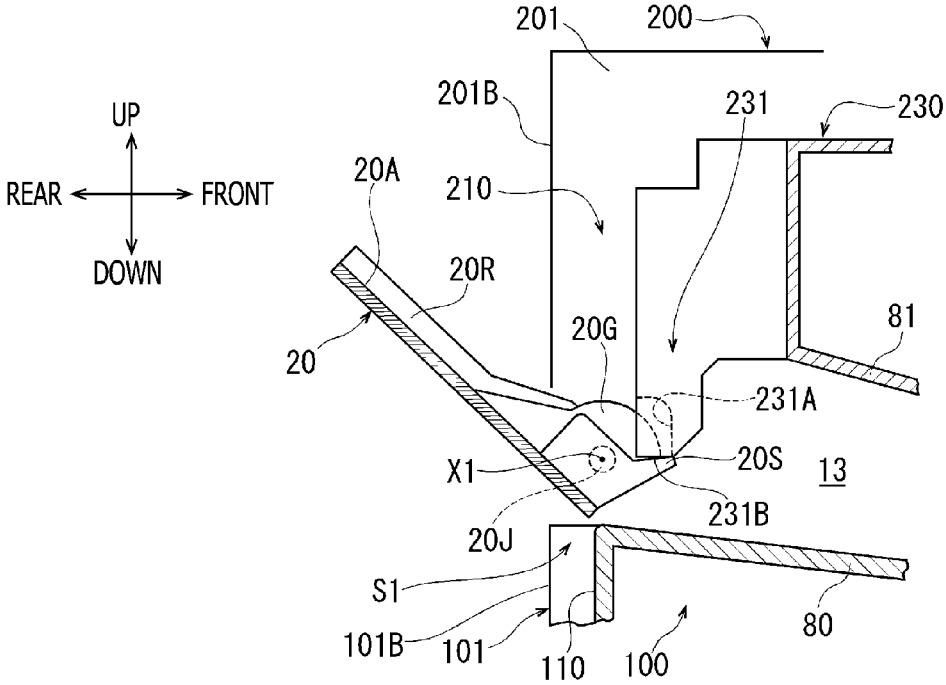
FIG. 7 is a partial cross section of the opening and closing member in the opened state viewed along an arrow VII shown in FIG. 4.
Figure 8:
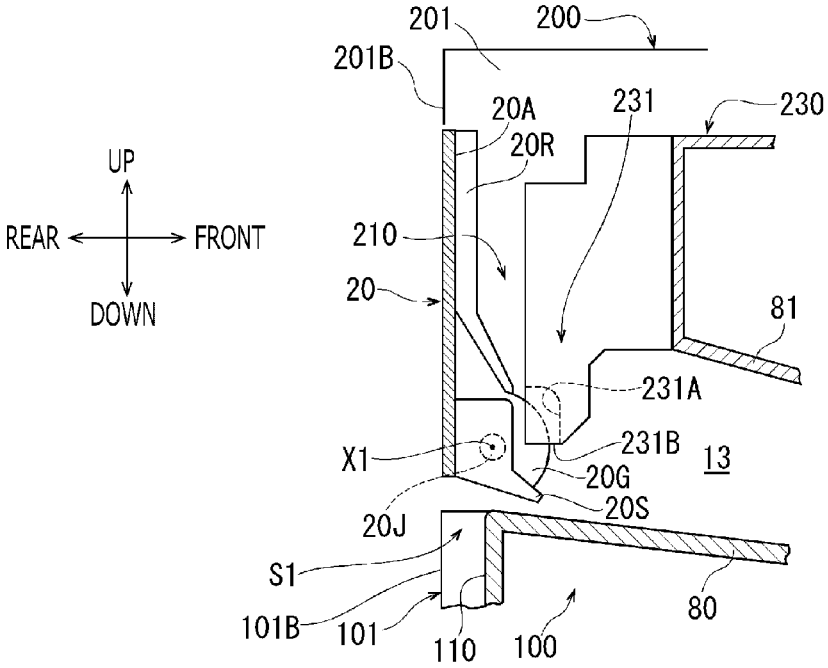
FIG. 8 is a partial cross section of the opening and closing member which has moved to the closed state from the opened state shown in FIG. 7.

As shown in FIGS. 4 and 6, the positioning part 231 is formed in a shape of a rectangular column extending downward from the scanner base 230, and is positioned on the front side of each of the shaft support members 240L and 240R. Under the positioning part 231, a guide groove 231A is formed to be opened toward the lower side and the rear side. As shown in FIGS. 4 and 7, in the vicinity of the side wall 20R of the supply tray 20, a guide rib 20G having a form of an arc whose axis center is in parallel with the swinging axis X1 is formed as a projection. When each shaft part 20J is inserted into the each shaft hole 264, the guide rib 20G is inserted into the guide groove 231A. As a result, as shown in FIGS. 7 and 8, when the supply tray 20 swings about the swinging axis X1, the guide rib 20G slides in the inside of the guide groove 231A, so that the supply tray 20 is positioned in the direction of the swinging axis X1.

As shown in FIGS. 4 and 7, in the vicinity of the guide rib 20G, a stopper 20S is formed on the supply tray 20 to protrude frontward. When the supply tray 20 is moved to the opened state shown in FIG. 4 or 7, the stopper 20S contacts a lower surface 231B of the positioning part 231 and stops, so that the supply tray 20 is held in the opened state.

On the side walls 20L and 20R of the supply tray 20, engagement parts (not shown) which elastically deform to engage with the inner surfaces 212L and 212R of the recessed part 210 are provided, respectively. With this structure, the closed state of the supply tray 20 can be locked.

Figure 9:
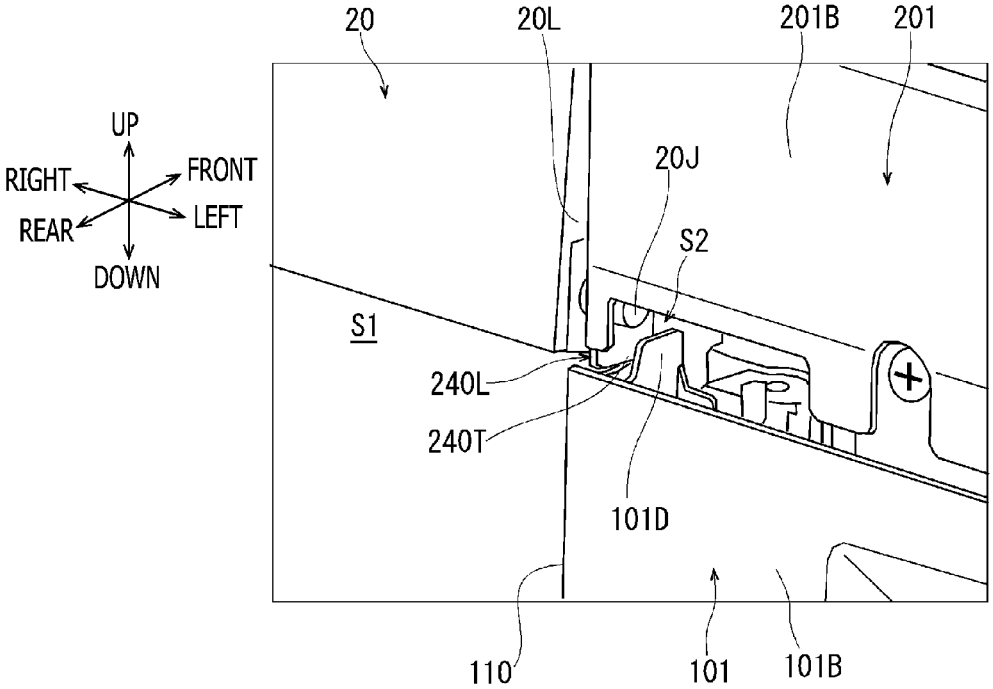
FIG. 9 is a partial perspective view illustrating a zone IX in FIG. 1 in an enlarged view.

As shown in FIGS. 5 and 9, between a surface 240T (which is opposite to the surface facing the supply tray 20) of the left shaft support member 240L and the first cover 201 constituting the reading housing 200, space S2 is secured. The space S2 serves as a clearance used for assembling the first cover 201, the scanner base 230 and the inner frame and for attaching the supply tray 20. Additionally or alternatively, the space S2 may be used as a layout space for inner components of the MFP 10.

At the left upper edge of the rear face 101B of the third cover 101, a rib 101D is integrally formed to protrude to the space S2. The rib 101D has a slender rectangular cross sectional shape in regard to the front and rear direction so as not to take up much space. The top edge of the rib 101D reaches a position near the left shaft part 20J of the supply tray 20 and the shaft hole 264 of the shaft support member 240L. With this configuration, it becomes possible to prevent the shaft part 20J from dropping out from the shaft hole 264. More specifically, even when the lower edge portion of the deformable part 260 of the shaft support member 240L deforms to be away from the side wall 20L of the supply tray 20, the rib 101D protruding to the space S2 restricts deformation of the lower edge portion of the deformable part 264. Therefore, it is possible to prevent the shaft part 20J from dropping off from the shaft hole 264. Optionally, a rib which is similar to the rib 101D may be provided at the right top edge of the rear face 101B of the third cover 101.

Since as described above both of the structure for supporting the supply tray 20 by the reading housing 200 and the structure of the rear face of the image formation housing 100 have the recessed parts (210, 110) at the central portion thereof, empty space 51 is secured between the recessed part 110 provided on the rear face 101B of the third cover 101 and the lower edge of the supply tray 20 in the closed state. The empty space 51 contributes to enhancing fineness of an outer appearance of the MFP 10 and achieving cost reduction. Furthermore, as shown in FIG. 7, the empty space 51 serves as a clearance for allowing the lower edge of the supply tray 20 to move without interfering with the rear face 101B of the third cover 101.

Hereafter, the sheet guide 21 is explained.

As shown in FIGS. 2 and 3, the sheet guide 21 having a rectangular shape elongated in the left and right direction is provided between the supply tray 20 and the recessed part 210.

In FIG. 4, to ensure that a rail groove 21B and an engagement hole 21C can be seen easily, the sheet guide 21 is omitted. The upper right and left edge parts (see FIG. 2) of the sheet guide 21 are slidably fitted into the rail grooves 21B, respectively. Each rail groove 21B is formed to extend in the vertical direction (see FIG. 4). On the other hand, lower right and left edge parts (see FIG. 2) of the sheet guide 21 contact the side walls 20L and 20R, respectively, and respectively engage with the engagement holes 21C formed in the direction parallel with the swinging axis X1.

When the supply tray 20 moves from the opened state to the closed state, the engagement hole 21C also swings frontward about the swinging axis X1. In this case, the lower edge side of the sheet guide 21 moves frontward, and the upper edge side of the sheet guide 21 moves upward while being guided by the rail grove 21B. As a result, the sheet guide 21 is brought to an upright position between the recessed part 210 and the supply tray 20 in the closed state, as shown by a dashed line in FIG. 3.

On the other hand, when the supply tray 20 moves from the closed state to the opened state, the engagement hole 21C also swings toward the rear side about the swinging axis X1. In this case, the lower edge of the sheet guide 21 moves toward the rear side, and the upper edge part of the sheet guide 21 moves downward while being guided by the rail groove 21B. As a result, the sheet guide 21 is brought to an inclined position where the sheet guide 21 is inclined with respect to the recessed part 210 toward the base plate 20A, as shown by a solid line in FIG. 3. Since the sheet guide 21 can be set in such an inclined position, the leading edge of the recording medium manually fed can be smoothly guided to the opening 13 via a gap formed between the lower edge of the sheet guide 21 and the surface of the base plate 20A on which the back face of the recording medium is supported. Such a configuration also enables the user who stands in front of the MFP 10 to manually insert the recording medium for manual feeding into the opening 13 which is hard to visually recognize because the opening 13 is formed on the rear side of the MFP 10.

Hereafter, advantages achieved by the above described embodiment are explained. As described above, the MFP 10 has the opening 13 on the rear side of the housing, i.e., on the rear face 201B of the first cover 201 constituting the reading housing 200. Furthermore, on the rear side of the scanner base 230 constituting the reading housing 200, the supply tray 20 is supported. In normal cases, when the user lifts the MFP 10, the user hooks the user' hand to the grip part 101C formed as a recessed part on the left and right sides (101L in FIG. 2) of the MFP 10. This is proper handling of the MFP 10. However, there is a case where the user puts the user's hand on the rear side of the reading housing 200 and the image formation housing 100. Specifically, when the user picks out the MFP 10 from a cardboard box or when the user slightly moves the MFP 10 frontward or backward from an installed position of the MFP 10, the user may put the user's hand on the rear side of the housings 100 and 200.

That is, the user may insert the user's hand into the empty space 51 situated under the lower edge of the supply tray 20 in the closed state, and may put the user's hand on the lower edge of the supply tray 20 (see FIGS. 3 and 5). In this case, as shown in FIG. 5, a force Γ pointing upward acts on the lower edge of the supply tray 20. As a result, the upward force F is applied as upward forces F1 and F2 (F1+F2=F) from the axis parts 20J to the shaft holes 264 of the shaft support members 240L and 240R, and is transmitted to each fixed part 250 via the deformable part 260. Therefore, on the fixed parts 250, reaction forces R1 and R2 pointing downward opposite to the upward forces F1 and F2 are produced.

Each deformable part 260 is formed such that the lower edge part thereof at which the shaft hole 264 is formed is shifted toward the center of the supply tray 20 with respect to the fixed part 250 when viewed from the rear side. That is, the positions of the upward forces F1 and F2 acting on the shaft holes 264 are respectively shifted toward the center side with respect to the reaction forces R1 and R2 acting on the fixed parts 250. In this case, bending moments M1 and M2 act on the deformable parts 260 in the direction of causing the shaft holes 264 formed at the lower edges of the deformable parts 260 to approach the side walls 20L and 20R of the supply tray 20, respectively. As a result, each deformable part 260 elastically deforms toward the root of each shaft part 20J of the supply tray 20. Such a configuration makes it possible to prevent each shaft part 20J from dropping out from the shaft hole 264.

Therefore, even if a force pointing upward is applied to the lower edge of the supply tray 20, the supply tray 20 can be prevented from dropping out from the scanner base 230.

In the MFP 10, each deformable part 260 includes the first dropping part 261, the crank part 263 and the second dropping part 262. The second dropping part 262 is longer than the first dropping part 261. Therefore, each shaft hole 264 can be easily deformed toward the root of each shaft part 20J of the supply tray 20. As a result, it becomes possible to further securely prevent each shaft paper 20J of the supply tray 20 from dropping out from each shaft hole 264.

Furthermore, thanks to the positioning part 231, the shaft support members 240L and 240R do not need to position the supply tray 20 in the direction of the swinging axis X1. Therefore, the degree of design freedom for the shaft support members 240L and 240R can be increased. That is, it becomes possible to design the shapes of the shaft support members 240L and 240R such that the supply tray 20 can be suitably opened and closed while securing the adequate deforming amount of the deformable part 260 to prevent the shaft parts 20J from dropping off from the shaft holes 264.

Since the opening 13 and the supply tray 20 are provided on the rear face of the reading housing 200, the MFP 10 can be downsized easily. However, in many cases, the user handles the MFP 10 while standing in front of the MFP 10. In this case, it is difficult for the user to visually recognize the lower edge portion of the supply tray 20 which is on the rear side of the MFP 10. Therefore, when the user lifts the MFP 10, the user tends to put the user's hand on the lower edge of the supply tray 20. According to the above described embodiment, even if such a situation occurs (i.e., even if a force pointing upward is applied to the lower edge of the supply tray 20, the supply tray 20 hardly drops out. That is, the advantages that the supply tray 20 can be prevented from dropping out from the MFP 10 can be securely achieved.

Although the present invention has been described in considerable detail with reference to certain preferred embodiments thereof, other embodiments are possible.

The empty space S1 may have various types of shapes. Specifically, the empty space S1 may have a shape of a step, a depression or a gap. For example, when an opening and closing member (i.e., the supply tray 20) is formed to protrude from the rear face of the housing in the closed state, space formed under the lower edge of the opening and closing member serves as the above described empty space S1. If the opening and closing member in the closed state is formed to be in plane with the rear face of the housing and a slender gap (e.g., a clearance for allowing a swinging motion of the opening and closing member) is formed between the lower edge of the opening and closing member and the housing in the left and right direction, such a gap may serve as the above described empty space S1.

In the above described embodiment, the deformable part is formed to have a shape of a crank. However, the shape of the deformable part is not limited to such a shape. The deformable part may be formed to have a form of an arc, an S-curve shape or a tapered shape.

The shaft support member may be provided on the first cover 201. The shaft support member may be formed as a separate member. In this case, a fixed part of such a shaft support member may be fixed to the housing.

The opening and closing member may be a open/close cover for maintenance which is opened or closed for maintenance (e.g., replacement of a component (e.g., an ink cartridge), or recovery work for paper jam).

What is claimed is:

1. An image forming device, comprising:

a housing comprising an opening on one side thereof, the housing accommodating an image formation unit;

an opening and closing member rotatably supported by the housing, the opening and closing member being able to swing, about a swinging axis provided on a lower side of the opening and closing member, between an opened state where the opening is exposed and a closed state where the opening is covered by the opening and closing member but a space under the lower edge of the opening and closing member is formed;

a pair of shaft parts respectively provided at lower portions of side walls of the opening and closing member to protrude outward away from each other along the swinging axis, the side walls being formed to face each other while sandwiching a lower edge of the opening and closing member between the side walls;

and a pair of shaft support members respectively provided on the housing at portions where the housing faces the side walls of the opening and closing member, wherein:

each of the pair of shaft support members has a shaft hole into which a respective one of the pair of shaft parts is inserted;

each of the pair of shaft support members has a fixed part provided at an upper portion of the shaft support member to be fixed to the housing, and a deformable part integrally formed with the fixed part to extend downward from the fixed part, the deformable part comprising a corresponding one of the shaft holes; and the deformable part is formed such that a lower edge part of the deformable part is positioned on a center side of the opening and closing member with respect to a position of the fixed part when viewed from the side on which the opening is formed so that, when an upward force is applied to the lower edge of the opening and closing member, the deformable part is deformed such that the shaft holes respectively approach the side walls of the opening and closing member.

2. The image forming device according to claim 1, wherein the opening and closing member is a supply tray formed to support a back face of a recording medium in the opened state and to guide the recording medium, via the opening, toward the image formation unit provided in the housing.

3. The image forming device according to claim 1, wherein the deformable part comprises:

a first dropping part formed to extend downward from the fixed part;

a crank part formed to bend toward the center side of the opening and closing member from a lower edge of the first dropping part; and a second dropping part formed to extend downward from an end of the crank part opposite to a first dropping part side end of the crank part, the corresponding shaft hole being formed in the second dropping member.

4. The image forming device according to claim 3, wherein the second dropping part is longer than the first dropping part.

5. The image forming device according to claim 1, wherein the housing has a positioning part which positions the opening and closing member in a direction of the swinging axis.

6. The image forming device according to claim 1, wherein at least one of the pair of shaft support members has a guide part which guides a corresponding one of the shaft parts to the corresponding shaft hole.

7. The image forming device according to claim 1, wherein:

the housing comprises a reading housing constituting an upper part of the housing to accommodate therein the image formation unit;

the opening is formed on a rear side of the reading housing;

the opening and closing member is attached to the rear side of the reading housing to be able to swing; and the pair of shaft support members is provided on the rear side of the reading housing at positions where the reading housing faces the side walls of the opening and closing member.

8. The image forming device according to claim 7, wherein:

a gap is formed between the reading housing and at least one of the pair of shaft support members; and on a rear side of the housing, a rib is formed to protrude to the gap.

* * * * *